United States Patent [19]

Höglinger

[11] 4,392,662

[45] Jul. 12, 1983

[54] DEVICE FOR FACILITATING PARTICULARLY THE LOADING AND UNLOADING OF CONTAINERS ETC. FROM VEHICLES ETC.

[76] Inventor: Norbert Höglinger, Via Stazione, 34, I-Caldaro (Bozen), Italy

[21] Appl. No.: 277,259

[22] Filed: Jun. 25, 1981

[30] Foreign Application Priority Data

Jul. 10, 1980 [IT] Italy ..... 4829 A/80

[51] Int. Cl.[3] ..... B60P 1/64

[52] U.S. Cl. ..... 280/43.23; 414/498

[58] Field of Search ..... 414/498; 254/45; 280/43.17, 43.2, 43.21, 43.23, 766; 296/164

[56] References Cited

U.S. PATENT DOCUMENTS

| | | | |
|---|---|---|---|
| 2,939,879 | 5/1960 | Lion | 414/498 X |
| 3,002,760 | 10/1961 | Lee | 414/498 X |
| 3,883,020 | 5/1975 | Dehn | 414/498 |

*Primary Examiner*—Robert G. Sheridan
*Attorney, Agent, or Firm*—Daley & Brandt

[57] ABSTRACT

A container structure includes a pair of telescopic leg assemblies externally mounted vertically on its rear wall, a telescopic leg assembly externally mounted vertically on each of its side walls in forward locations thereon rearwardly displaced from the front wall of the container structure so as to provide the latter with a cantilever front end, a swivel caster at the end of the leg of each leg assembly and swivel casters mounted on the bottom wall of the container structure at the cantilever front end and also proximately in front of the rear wall leg assemblies. With all legs of the leg assemblies extended, one can readily roll the container structure up to an elevated loading platform (such as a flatbed of a truck) so as to position the cantilever front end above the platform, then retract the legs of the forwardly located leg assemblies to lower the front end into caster engagement with the platform, thereafter push the container structure forwardly until the bottom casters near the rear wall leg assemblies are above the platform, and finally retract the legs of the rear wall container leg assemblies to lower the rear end of the structure into caster engagement with the platform, thereby facilitating further manual maneuvering to complete the loading of the container structure on the platform.

1 Claim, 2 Drawing Figures

DEVICE FOR FACILITATING PARTICULARLY THE LOADING AND UNLOADING OF CONTAINERS ETC. FROM VEHICLES ETC.

Loading walls for loading and unloading goods are known, but these loading walls are operated hyraulically, are provided on rather large trucks, and permit only shifting loads from the normal level to the level of the loading surface and vice versa. The object of the invention is to provide a simple device which permits loading, unloading and shifting containers etc. filled with goods by a single person. This problem is solved according to the invention in this way that it is suggested to provide on a container etc. wheels or rollers at the end of extensible legs in such a way that it permits loading, unloading and shifting by utilizing the loading surface.

The telescopic legs have spindle nut thread mechanisms, hydraulic means, lever mechanisms etc. so that the containers can be raised and lowered by operating these means. In order to permit shifting of the container on the loading surface, preferably on the floor, rollers or swivel casters can be provided. According to the invention, one pair of telescopic legs is provided laterally on the container in such a way that a part of the latter projects unsupported with regard to the telescopic legs.

A second pair of telescopic legs is arranged in the range of the rear wall of the container. Preferably wheels etc. are provided on the bottom of the container in the unsupported section and in front of the pair of rear telescopic legs. During the loading phase, the telescopic legs are so operated that the container is raised slightly above the level of the loading surface. Then the load is pushed with the cantilever portion over the loading surface; by retracting the legs close to the loading surface, the load rests first on the loading surface with the wheels provided on the bottom of the container; after the legs are completely retracted, it is pushed forward until the wheels, which are provided on the bottom of the container in front of the pair of rear legs, are above the loading surface. In this position the rear legs can likewise be completely retracted, and the container can be displaced by means of the wheels provided on the bottom or by means of rollers or wheels provided on the loading surface.

During the unloading, the operating phases are reversed.

The invention does not exclude a paired drive of the telescopic legs, or a hydraulic or pneumatic drive over a pressure unit operated by the vehicle.

The invention will be described more fully on the basis on an embodiment represented schematically in the drawing.

Figure 1:
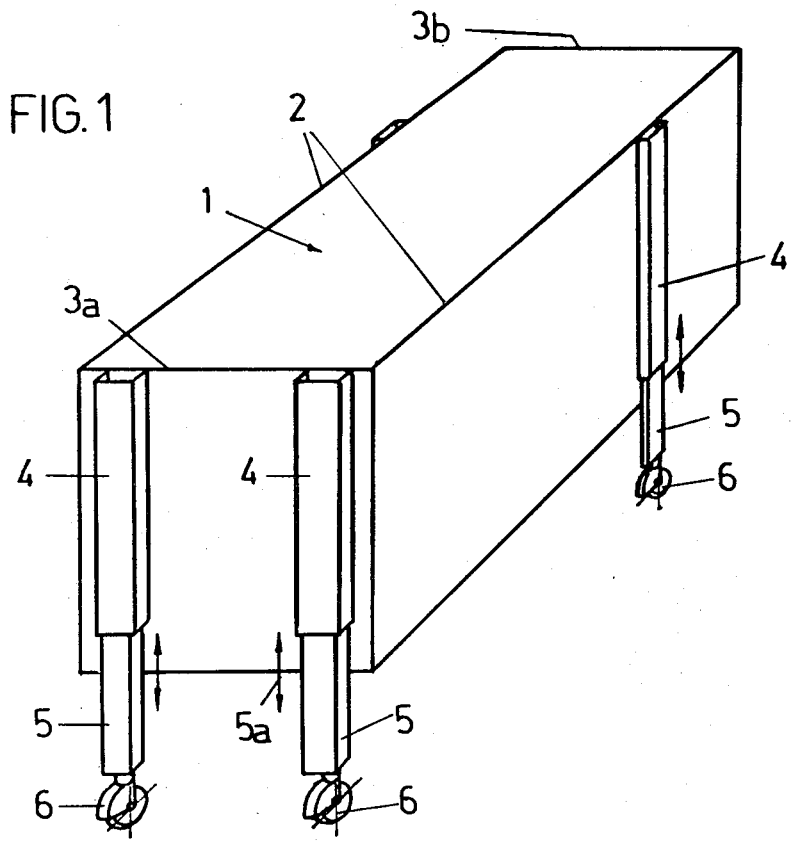
FIG. 1 shows in a schematic perspective view a container with the device according to the invention.
Figure 2:
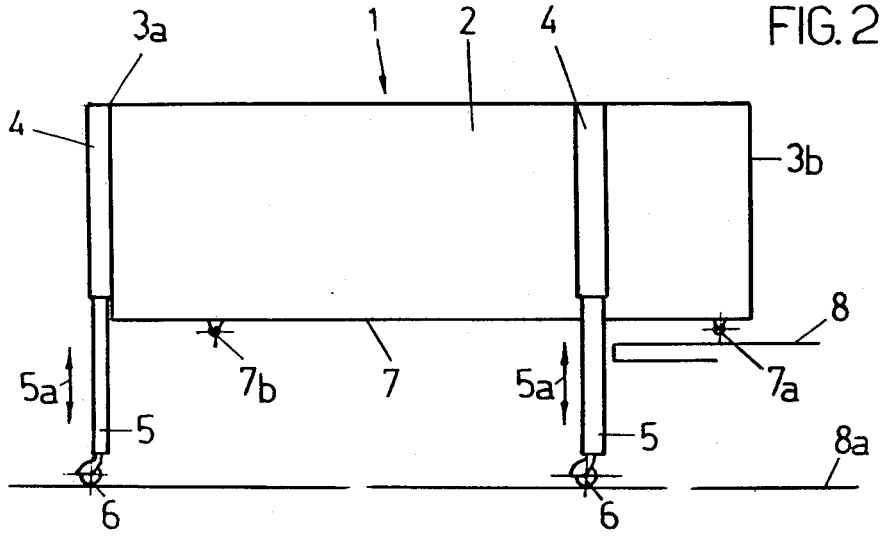
FIG. 2 shows in a schematic side elevation a container while changing from the floor to the loading surface.

Container 1 has a front wall 3*b*, a rear wall 3*a*, side walls 2, and on rear wall 3*a* are provided pairs of telescopic legs in such a way that a part of the container projects unsupported; the telescopic legs consist of a stationary part 4 and of a part 5 which can be extended by means of a mechanism which permits easy raising or lowering 5*a* of the load by hand, or by hydraulic or pneumatic means. At the free ends of the telescopic legs are provided swivel casters 6.

On the bottom of the container are provided in front of the pairs of telescopic legs swivel casters 7*a*, 7*b* on which the container is shifted when changing from one plane 8 to another plane 8*a*.

The invention does not exclude individual, paired or multiple operation of the telescopic legs.

I claim:

1. A container structure comprising, in combination: a bottom wall; an upstanding front wall; an upstanding rear wall; an opposed pair of upstanding side walls; a first pair of like telescopic leg assemblies vertically mounted upon the exterior surface of said rear wall in spaced parallel relationship with one another, each leg assembly being inwardly displaced from a corner-defining junction of a respective side wall and said rear wall by an amount substantially less than its spacing from the other leg assembly; a second pair of like telescopic leg assemblies, each of which is vertically mounted upon the exterior surface of a respective side wall and is rearwardly equidistant from said front wall by an amount leaving said container structure with a substantial cantilever portion terminating in said front wall; a first set of swivel casters mounted directly on said bottom wall forwardly of said first pair of telescopic leg assemblies and proximate thereto; a second set of swivel casters mounted directly on said bottom wall within the cantilever portion of said container structure; and a respective swivel caster mounted on the lower end of the leg of each telescopic leg assembly; the arrangement being such that, with the legs of the telescopic leg assemblies initially extended, one can roll said container structure along a horizontal base surface to position said cantilever portion over a stationary parallel elevated surface, then retract the legs of said second pair of telescopic leg assemblies to lower said cantilever portion and obtain rolling support thereof on said elevated surface by said second set of swivel casters, thereafter forwardly roll said container structure until said first set of swivel casters is positioned over said elevated surface, and finally retract the legs of said first pair of telescopic leg assemblies to obtain rolling support of the rear end of the container structure on said elevated surface by said first set of swivel casters, thereby to facilitate completion of the loading of the container structure onto said elevated surface.

* * * * *